United States Patent [19]

Fujii et al.

[11] Patent Number: 4,762,099

[45] Date of Patent: Aug. 9, 1988

[54] VALVE ACTUATING DEVICE OF FOUR-CYCLE INTERNAL COMBUSTION ENGINE

[75] Inventors: Noriaki Fujii; Takeshi Iwata; Toshihiro Oikawa; Naoki Takahara, all of Wako, Japan

[73] Assignee: Honda Giken Koygo Kabushiki Kaisha, Tokyo, Japan

[21] Appl. No.: 70,497

[22] Filed: Jul. 7, 1987

[30] Foreign Application Priority Data

Jul. 8, 1986 [JP] Japan ..... 61-160358
Jul. 9, 1986 [JP] Japan ..... 61-162862

[51] Int. Cl.[4] ..... F01L 1/18

[52] U.S. Cl. ..... 123/90.44; 123/90.43; 123/90.45

[58] Field of Search ..... 123/90.41, 90.43, 90.45, 123/90.44

[56] References Cited

U.S. PATENT DOCUMENTS 4,672,927 6/1987 Uchida ..... 123/90.44

FOREIGN PATENT DOCUMENTS 606405 6/1926 France ..... 123/90.45
168208 9/1984 Japan ..... 123/90.44
144990 6/1920 United Kingdom .
1400254 7/1975 United Kingdom .
1552786 9/1979 United Kingdom ..... 183/90.45
2115068 9/1983 United Kingdom ..... 123/90.44

*Primary Examiner*—E. Rollins Cross
*Attorney, Agent, or Firm*—Armstrong, Nikaido, Marmelstein & Kubovcik

[57] ABSTRACT

In a valve actuating device of four-cycle internal combustion engine, a valve actuating cam shaft for driving an opening and closing valve via a rocker arm is carried on a cam holder block, an adjusting bolt is held on the cam holder block so as to be adjustable relative to its position to the latter and the rocker arm is supported on a pivot portion integral with the adjusting bolt for rocking motion. Valve clearance between the rocker arm and the opening and closing valve is adjusted by displacing the position of adjusting bolt relative to the cam holder block.

14 Claims, 10 Drawing Sheets

VALVE ACTUATING DEVICE OF FOUR-CYCLE INTERNAL COMBUSTION ENGINE

BACKGROUND OF THE INVENTION

1. Field of the Invention

The present invention relates to an improvement in valve actuating devices of a four-cycle internal combustion engine.

2. Description of the Prior Art

Conventionally as a valve actuating device of a four-cycle internal combustion engine, there has been known, for instance, such type in which a rocker arm shaft is provided on a cam holder which is fixed to the upper side of a cylinder head and a rocker arm is carried rockably on the shaft and is operatively connected at one end thereof with a valve actuating cam and at the other end with an opening and closing valve (an intake or exhaust valve) via an adjuster which is adapted to adjust a valve clearance. See Japanese Patent Application Publication Kokai No. 172409/83.

The above conventional device, however, suffers from the following problems:

1. A rocker arm shaft for carrying a rocker arm, a coil spring, used to hold the arm in place, and the like components must be provided necessitating a large number of parts in the whole structure, which makes the device complicated and of a large size and heavy weight; and 2. A valve clearance adjusting means is provided on the rocker arm and makes large the mass of movable parts of the valve actuating device, which results in a lower followability of the device to a high speed engine operation.

SUMMARY OF THE INVENTION

Accordingly it is the primary object of the invention to provide a valve actuating device of a four-cycle internal combustion engine, which is simple in structure and is set free of the above-noted problems by eliminating the rocker arm shaft and further by removing the valve clearance adjusting means from the movable parts of the device.

The present invention proposes a structure that a cam holder block for carrying a valve actuating cam shaft is fixed to the body of an engine, the cam holder block holds an adjusting relative to its position bolt in a manner that the bolt is adjustable to the cam holder block, said adjusting bolt having an integral pivot portion provided at one end thereof, on the pivot portion is rockably supported a rocker arm which is operatively connected with a valve actuating cam on the valve actuating cam shaft and which is also operatively connected at its free end portion with an opening and closing valve in a direct fashion.

When the valve actuating cam shaft rotates, the rocker arm is caused to rock around the pivot portion of the adjusting bolt held on the cam holder block, thereby imparting opening and closing actions to the opening and closing valve (intake or exhaust valve) which is operatively connected to the free end portion of the rocker arm.

With the above arrangement, rocker arm shafts used for carrying conventional intake or exhaust rocker arms, coil springs for positioning those rocker arms and the like components are eliminated, permitting the valve actuating device to have a simplified structure with less number of parts. As a result, the device can be made compact and light-weighted. Moreover, since it is proposed that a valve clearance adjusting means for the valve actuating device be disposed on the cam holder block, the movable part of the device can be reduced in mass thereby enhancing the followability of the movable part in the operational range where the valve actuating cam shaft is driven and rotated at a high speed, and therefore improving the engine performance at the high speed range.

Other objects, features and advantages pertaining to the invention will become apparent from reading of the following description of some embodiments in conjunction with the attached drawings.

BRIEF DESCRIPTION OF THE DRAWINGS

FIGS. 1–5 show a first embodiment according to the invention wherein FIG. 1 is a side view in longitudinal section of the head portion of an engine equipped with a device of this embodiment, taken along line I—I of FIG. 2, FIG. 2 is a plan view of the engine with its head cover being removed therefrom, FIG. 3 is a bottom view of a part of the cylinder head taken along line III—III of FIG. 1, FIG. 4 is a perspective view of the rocker arm and its supporting part in disassembled state, and FIG. 5 is a perspective view of the rocker arm and its supporting part in assembled state.

FIGS. 6 and 7 show a second embodiment in which FIG. 6 is a perspective view of the rocker arm and its supporting part in assembled state and FIG. 7 is a cross sectional view taken along line VII—VII of FIG. 6 showing a part on an enlarged scale.

FIGS. 8–13 show a third embodiment in which FIG. 8 is a side view in longitudinal section of the head portion of an engine equipped with a device of this embodiment, taken along line VIII—VIII of FIG. 9, FIG. 9 is a plan view of the engine, FIG. 10 is a view seen along the arrow X of FIG. 9, FIGS. 11 and 12 are sectional views taken along lines XI—XI and XII—XII of FIG. 8, and FIG. 13 is a perspective view of the rocker arm and its supporting part in partially disassembled state.

DESCRIPTION OF PREFERRED EMBODIMENTS

Hereinafter some embodiments according to the invention will be explained with reference to the accompanying drawings. In these embodiments, the present invention has been applied to OHC type valve actuating devices of a four-valve type four-cycle multi-cylinder internal combustion engine having two intake valves and two exhaust valves per cylinder. Corresponding parts have been indicated by corresponding numerals and characters through the embodiments. Further in the following description, intake valves and/or exhaust valves correspond to an opening and closing valve according to the invention, and intake cams and/or exhaust cams correspond to a valve actuating cam of the invention.

Figure 1:
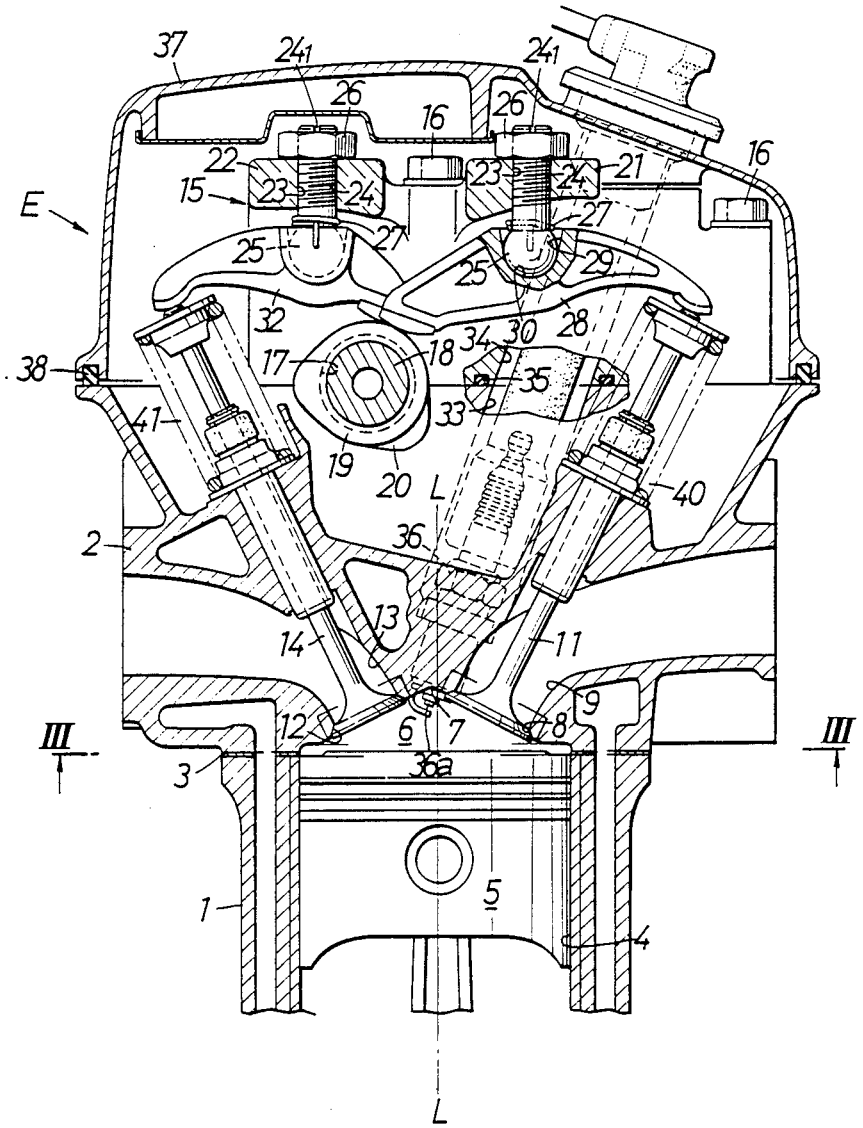
Figure 2:
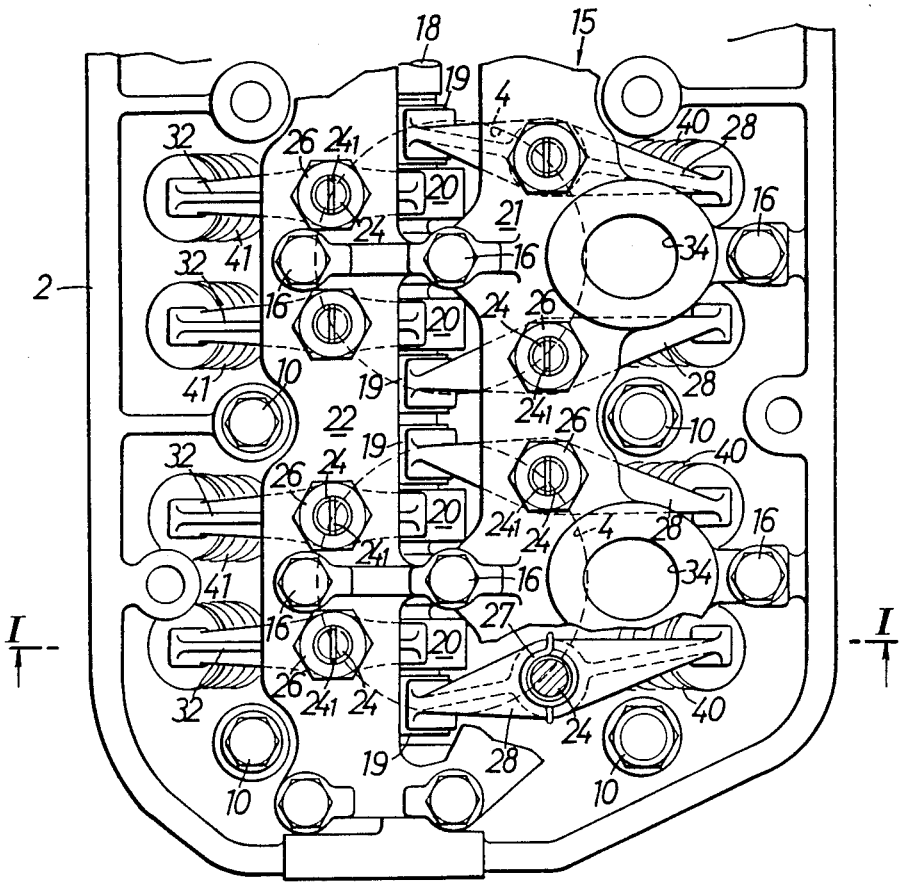
Figure 3:
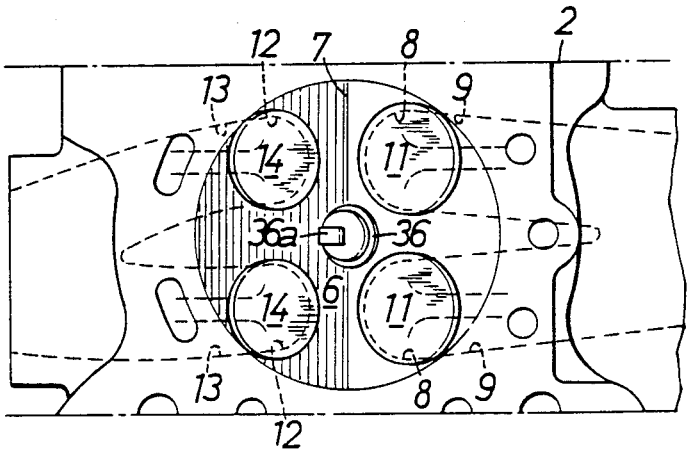

FIGS. 1–5 illustrate a first embodiment according to the invention. Therein is shown a body E of SOHC type four-valve internal combustion engine. Engine body E includes a cylinder block 1 and a cylinder head 2 fixed in superposition to the upper side of cylinder block 1 via a gasket 3 by means of a plurality of fixing bolts 10. The cylinder block 1 is formed with a plurality of (for example, four) cylinders 4 into which pistons 5 are slidably fitted, respectively. The cylinder head 2 is defined on its inner side surface with combustion chambers 6 each facing the upper surface of corresponding piston 5. Each combustion chamber 6 has a roof surface 7 formed into the shape of a chevron having mutually opposing inclined surfaces. As shown in FIG. 3, to one side part of the roof surface 7 of the combustion chamber 6 are opened two intake valve openings 8 having the same diameter in a side-by-side arrangement and to the other side part of the surface 7 are opened two exhaust valve openings 12, having a diameter slightly smaller than that of the intake valve openings 8, in the similar side-by-side arrangement. Thereby, the two intake valve openings 8 are located opposed to the two exhaust valve openings 12, respectively.

Intake ports 9 communicating with the said two intake valve openings 8 are formed in the cylinder head 2 and they are merged into one in the cylinder head 2, having an opening on one side surface of the head, to be connected via an intake manifold to a fuel supply device such as a carburetor. To the two exhaust valve openings 12 are connected exhaust ports 13 formed in the cylinder head 2. The exhaust ports 13 are merged into one duct within the cylinder head 2, which duct has an opening on the other side surface of the head and is connected to an exhaust system via an exhaust manifold.

On the cylinder head 2 are carried a pair of intake valves 11 for opening and closing the said two intake valve openings 8 and a pair of exhaust valves 14 for opening and closing the two exhaust valve openings 12, respectively, so as to be slidable in the vertical direction. The pair of intake valves 11 and the pair of exhaust valves 14 are disposed inclining on opposite sides of the central axis L—L of the cylinder 4 so as to become apart from each other gradually toward their upper or stem ends. These intake and exhaust valves 11 and 14 are urged in their closing direction by respective valve springs 40 and 41.

A cam holder block 15 is fixedly secured to the upper side surface of the cylinder head 2 by a plurality of fixing bolts 16 . . . . On that side of the central axis L—L of the cylinder 4 offset toward the exhaust valve 14 is defined a bearing hole 17 between mating surfaces of the cylinder head 2 and the cam holder block 15. A valve actuating cam shaft 18, formed integrally with valve actuating cams, that is, intake cams 19 and exhaust cams 20, is rotatably supported in this bearing hole 17.

Figure 4:
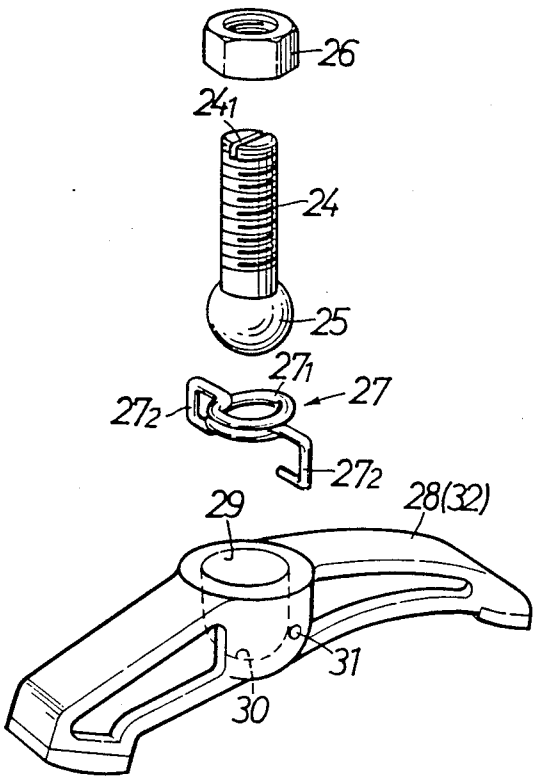
Figure 5:
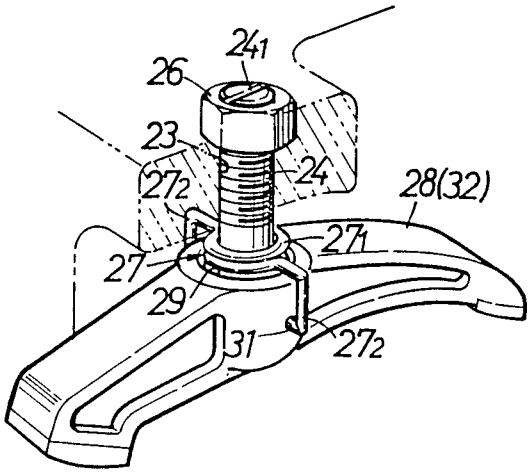

Cam holder block 15 includes an intake-side upper wall portion 21 and an exhaust-side upper wall portion 22 extending in the direction of array of the plurality of intake valves 11 and exhaust valves 14. In the intake-side upper wall portion 21 are bored two female screw holes 23 per one cylinder 4 and into each of the screw holes 23 is screwed an adjusting bolt 24 in such a manner that the bolt 24 can be adjusted its vertical position relative to the upper wall portion 21. The adjusting bolt 24 has a tool engagement groove $24_1$ on its upper end face and also has a pivot portion 25 of the spherical shape formed integrally on the lower end of the bolt. The adjusting bolt 24 is at its upper end screw-fitted with a lock nut 26 whose lower face engages the upper surface of the intake-side upper wall portion 21, whereby the adjusting bolt 24 is fixed to the wall portion 21. On the spherical pivot portion 25 of the adjusting bolt 24 is held an intake rocker arm 28 in a suspended fashion by means of a snap ring 27 so as to be rockable up and down around the pivot portion 25. More specifically, the intake rocker arm 28 is formed at its longitudinal central portion with a supporting hole 29 having an upper side opened and a bottom shaped into a semi-spherical recessed surface 30. The spherical pivot portion 25 is fitted into the supporting hole 29 with its semi-spherical lower half part being in relatively slidable contact with the recessed surface 30 of the hole 29. The snap ring 27 is, as shown in FIGS. 4 and 5, formed by winding a wire material such as steel wire into a shape consisting of a coil part $27_1$ and a pair of hook parts $27_2$ projecting from opposite sides of the coil part $27_1$. In assembling, the pivot portion 25 is first fitted into the supporting hole 29 as in the state of FIG. 5, then the coil part $27_1$ of the snap ring 27 is wound around the semi-spherical upper half part of the pivot portion 25 intimately using the resilient force of said coil part and simultaneously the pair of hook parts $27_2$ are straddled over the central portion of intake rocker arm 28 and are inserted at their tip ends into retaining holes 31, 31, bored in that central portion on opposite sides thereof, in a freely rotatable manner.

Thus, the intake rocker arm 28 is rockably suspended from the adjusting bolt 24 via the snap ring 27. The intake rocker arm 28 is operatively connected at its base end with the intake cam 19 on the valve actuating cam shaft 18 and at the free or tip end thereof with the stem end of the intake valve 11 directly.

The exhaust-side upper wall portion 22 is also bored with two female screw holes 23 per one cylinder 4. adjusting bolts 24 are screwed to these screw holes 23 also in a vertically adjustable manner and a lock nut 26 is tightened to the upper end of each adjusting bolt 24 with the lower face of the nut 26 being engaged on the upper surface of exhaust-side upper wall portion 22. An exhaust rocker arm 32 is suspended from the pivot portion 25 of adjusting bolt 24 through the medium of snap ring 27 quite similarly as the intake rocker arm 28. The exhaust rocker arm 32 is operatively connected at its base end with the exhaust cam 20 on the valve actuating cam shaft 18 and further at its free end with the stem end of the exhaust valve 14.

As illustrated in FIGS. 1 and 2, above the combustion chamber 6, a plug mounting hole 33 is bored in the cylinder head 2 in an inclined posture toward the intake valve 11 side from the central part of combustion chamber 6. A plug insertion hole 34, aligned with the plug mounting hole 33, is bored also at certain inclination in the cam holder block 15. O-ring 35 is interposed between mating surfaces of the cylinder head 2 and the cam holder block 15 so as to encircle the plug mounting hole 33 and insertion hole 34. An ignition plug 36 is inserted through the insertion hole 34 and then is housed in the mounting hole 33 and is mounted by screw to the wall of the combustion chamber 6. Its electrodes **36*a* are exposed to the central part of chamber 6**.

To the upper peripheral edge of the cylinder head 2 is superposed and fixedly secured via a seal ring 38 a head cover 37 for covering the valve actuating device.

Next, the operation of this first embodiment will be described.

When the valve actuating cam shaft 18 is driven and rotated by the engine operation, respective one pairs of intake rocker arms 28 and exhaust rocker arms 32 per one cylinder 4 are caused to rock around the pivot portion 25 of adjusting bolt 24 thereby imparting, in cooperation with the valve springs 40 and 41, opening and closing actions to the pairs of intake valves 11 and exhaust valves 14.

When it is desired to adjust the valve clearance for the intake valve 11 or the exhaust valve 14 (that is, the clearance between the stem end of intake valve 11 and the free end of intake rocker arm 28 or the clearance between the stem end of exhaust valve 14 and the free end of exhaust rocker arm 32), the lock nut 26 is rotated in its loosening direction and then the adjusting bolt 24 is rotated by inserting a tool into the groove $24_1$ and moved upwards or downwards. This causes a vertical displacement of the center of rocking motion of the intake rocker arm 28 or exhaust rocker arm 32, resulting in an adjustment of said valve clearance.

Figure 6:
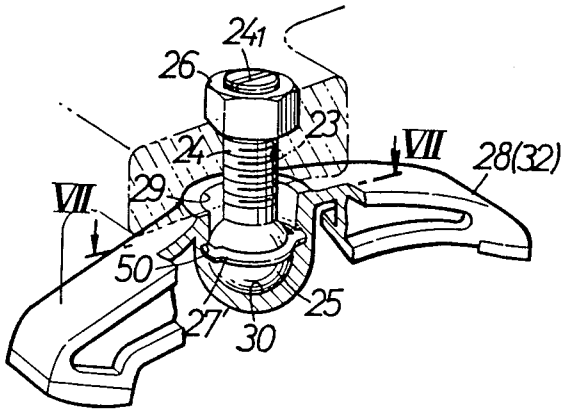
Figure 7:
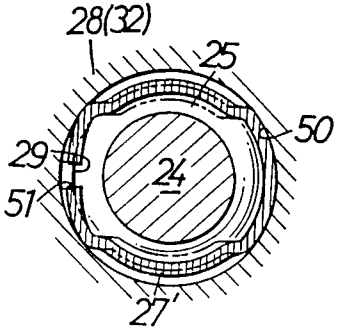

FIGS. 6 and 7 show a second embodiment of the invention wherein the adjusting bolt 24 includes a modified form of suspension means for suspending the intake and exhaust rocker arms 28, 32. Namely, on the inner wall of the supporting hole 29 of each of the rocker arms 28, 32 is provided an annular groove 50 extending generally on a horizontal plane and this annular groove 50 tightly receives a snap ring 27' having a notch 51. The snap ring 27' is in assembled state resiliently abutted against the semi-spherical upper half part of the pivot portion 25. Accordingly, the intake or exhaust rocker arm 28 or 32 is rockably suspended on the pivot portion 25 via said snap ring 27'.

FIGS. 8–13 show a third embodiment according to the invention.

In this embodiment, different from the afore-mentioned first embodiment, it is only the intake valve that receives a driving force from the valve actuating cam shaft via a rocker arm. The exhaust valve is constructed to directly receive the driving force from the valve actuating cam shaft at a tappet which is provided on the stem end of the valve.

A valve actuating cam shaft 118 takes a position offset toward the exhaust valve 14 side from the central axis L—L of the cylinder 4 and upwards of the valve 14. The cam shaft 118 is rotatably carried between the cylinder head 2 and a cam holder block 115 which is fixed to the upper surface of the cylinder head 2 by a plurality of fixing bolts 116 . . . .

A tappet 145 is provided on the stem end of each of the exhaust valves 14 and this tappet is operatively connected with an exhaust cam 120 formed on the valve actuating cam shaft 118 directly. Thereby, rotation of the cam shaft 118 drives and opens the exhaust cam 14 through mutual engagement of the exhaust cam 120 and tappet 145.

On the other hand, each of the intake valves 11 is at its upper stem end operatively connected with the free end or tip end of an intake rocker arm 128 which is in turn operatively connected at the base end thereof with an intake cam 119 formed on the valve actuating cam shaft 118.

The intake rocker arm 128 is, at its longitudinally central part, suspended for rocking motion on a pivot portion 125 that is integrally formed at the lower end of an adjusting bolt 124. The cam holder block 115 includes an integral upper wall portion 121 extending in a bridge-like form above the upper surface of the cylinder head 2 with some distance therebetween and the adjusting bolt 124 is held on that upper wall portion 121 so as to be adjustable its vertical position relative to the latter, as can be seen clearly in FIG. 10.

As a result, the intake rocker arm 128 is carried by the pivot portion 125 formed at the lower end of the adjusting bolt 124 which is retained on the upper wall portion 121 of the cam holder block 115, and the driving force from the intake cam 119 generates rocking motion of the intake rocker arm 128 around the pivot portion 125 thereby imparting opening action to the intake valve 11.

Figure 8:
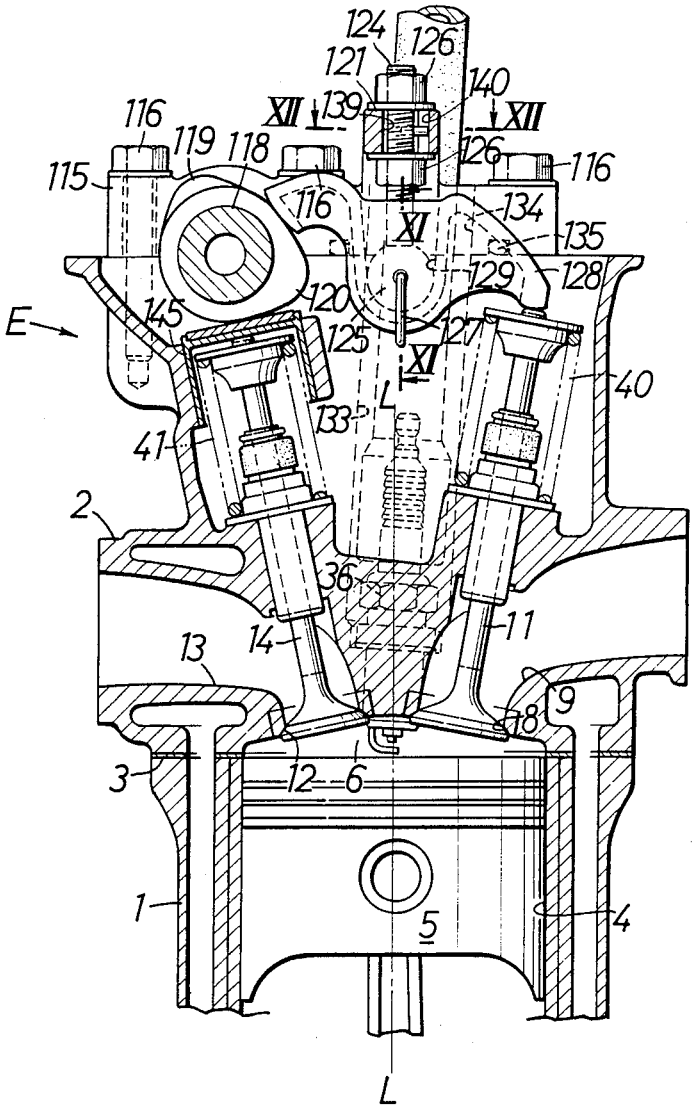
Figure 9:
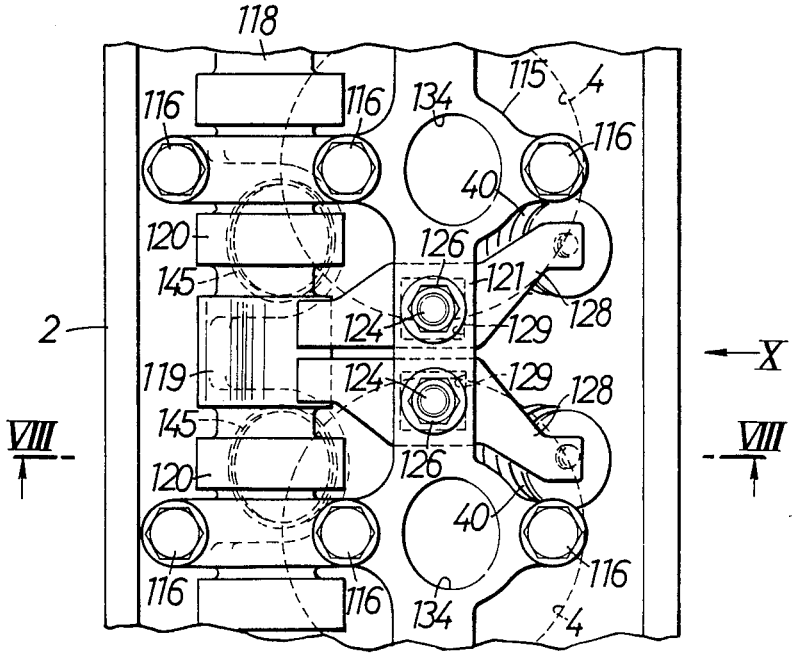
Figure 10:
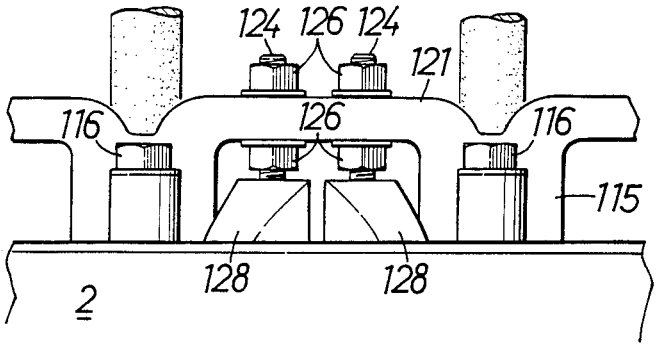
Figure 12:
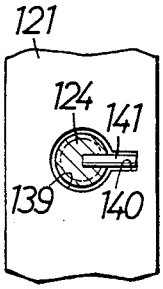
Figure 13:
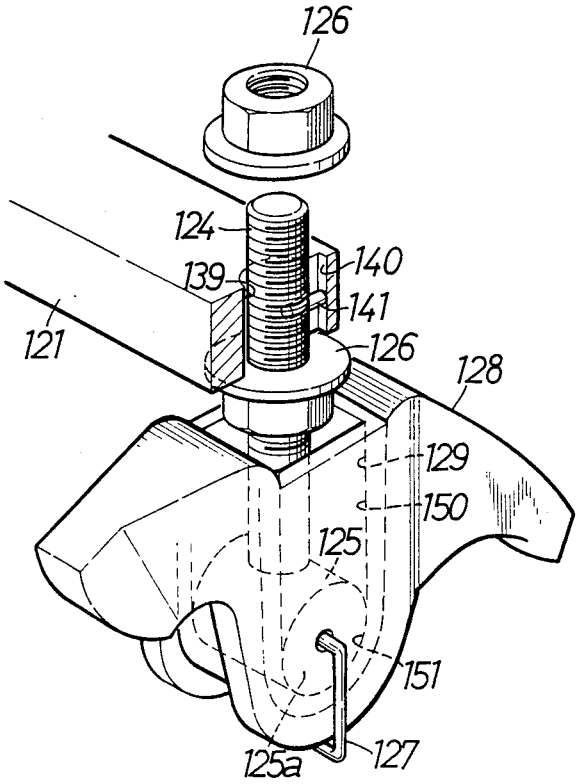

As shown in FIGS. 8, 12 and 13, a cylindrical fixing hole 139 for the adjusting bolt 124 is bored in the upper wall portion 121 of cam holder block 115 so as to penetrate vertically therethrough. Further formed continuously with the inner peripheral surface of the fixing hole 139 is a recessed groove 140 which similarly extends in the vertical direction. The adjusting bolt 124 has its outer diameter determined slightly smaller than the inner diameter of the fixing hole 139 and is provided with a regulating pin 141 projecting radially at a vertically intermediate portion of the bolt. The regulating pin 141 is slidably received within the recessed groove 140 upon fitting of the adjusting bolt 124 into the fixing hole 139, whereby the adjusting bolt 124 is prevented any circumferential displacement within the fixing hole 139. A pair of nuts 126, 126 are tightened to the adjusting bolt 124 at positions coming into abutment against the upper and lower surfaces of the upper wall portion 121 of the cam holder block 115, thus fixing the vertical position of the adjusting bolt 124 with respect to the upper wall portion 121.

The pivot portion 125 integrally formed on the lower end of the adjusting bolt 124 is, according to this embodiment, in the form of a column laid down horizontally and has its axis, in other words, opposite flat side faces **125*a*, positioned in a direction perpendicular to the rocking direction of the intake rocker arm 12 in the fixed position of the adjusting bolt 124 relative to the upper wall portion 121. On the other hand, the intake rocker arm 128 is, at its longitudinally central portion, formed with a bottomed supporting hole 129 having an upper side opened. The supporting hole 129 comprises an upper-side guide hole part 150 of a square cross section and a lower-side recessed part 151 formed continuously with the guide hole part 150. The recessed part 151 has the bottom surface of a circular arc between opposed flat side walls, conforming to the external shape of a lower half of the afore-mentioned columnar pivot portion 125. In an assembled state, the pivot portion 125 is held engaged with the lower recessed part 151 of the supporting hole 129, as a result of which the intake rocker arm 128 can perform a smooth up and down rocking motion around the pivot portion 125 owing to the sliding engagement between the outer peripheral surface of columnar pivot portion 125 and the recessed part 151 while being prohibited its sideward or lateral oscillation by the flat side faces 125*a* of pivot portion 125 coming into abutment against the flat side walls of supporting hole 129**.

Figure 11:
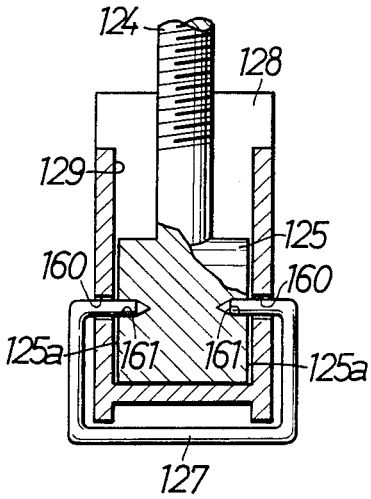

At opposite side walls of the rocker arm 128 and at the flat side faces **125*a* of the pivot portion 125 are provided holes 160, 160; 161, 161 which are placed in alignment with each other on assembly, as shown in FIG. 11, and into these holes a clip 127 is inserted and retained at its two retaining ends so as to clamp the rocker arm 128 from both sides. Due to use of this clip 127, when the cam holder block 115 is disassembled from the cylinder head 2 such as for maintenance, the rocker arm 128 is taken out along therewith while being held on the upper wall portion 121. Therefore, the efficiency of maintenance work can be improved. In addition, lubricating oil supplied to the pivot portion 125 can be discharged outside through the clip retaining holes 160, 160 provided in the rocker arm 128 thereby preventing accumulation of the oil around the pivot portion 125**.

Reference numeral 134 denotes a plug insertion hole provided in the cam holder block 115 in alignment with a plug mounting hole 133 in the cylinder head 2. Reference numeral 135 indicates a seal member for providing a tight sealing at connecting parts of the plug mounting hole 133 and the plug insertion hole 134.

In case of this third embodiment, when it is required to adjust the amount of clearance between the stem end of intake valve 11 and the tip end of intake rocker arm 128, that is, the valve clearance for the intake valve 11, first the pair of nuts 126, 126 are loosened, the vertical position of the adjusting bolt 124 relative to the upper wall portion 121 is adjusted so as to give a desired amount to the valve clearance, and thereafter the nuts 126, 126 are tightened up again to fix the bolt 124 on the upper wall portion 121.

Incidentally, the clip 127 may be omitted from this embodiment.

Figure 14:
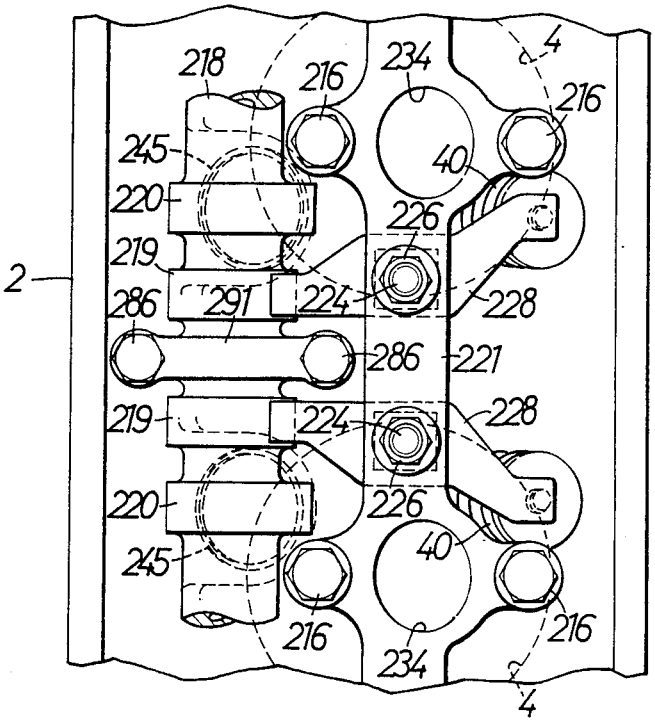
FIG. 14 shows a fourth embodiment and is a plan view of an engine according to this embodiment.

FIG. 14 shows a fourth embodiment, wherein as features differentiated from the third embodiment an arm holder portion 221 for holding intake rocker arms 228 and a cam holder portion 291 for holding a valve actuating cam shaft 218 are formed separate from each other. The arm holder portion 221 is mounted to the cylinder head 2 by a plurality of fixing bolts 216 . . . , whereas the cam holder portion 291 is mounted to the cylinder head by two bolts 286, 286. Unlike the third embodiment, adjacent two intake rocker arms 228, 228 are associated with two separate intake cams 219, 219, respectively, which are formed on the valve actuating cam shaft 218 on opposite sides of the cam holder portion 291.

Owing to this arrangement, when either one of the valve actuating cam shaft 218 or the intake rocker arm 228 has to be disassembled and taken out from the engine body for maintenance, the other component need not be released its assembled state so that the work of disassembling and reassembling can be made more efficient.

In the foregoing embodiments, the valve actuating devices have been constructed in an OHC type but they should not be limited thereto. It would also be apparent that the invention can be applied to a structure having a rocker arm pivoted at its base end to a holder. Moreover, the pivot portion may have any arbitrary shape on condition that it can permit desired rocking motion of the rocker arm while simultaneously restricting sideward oscillation thereof.

What is claimed is:

1. A valve actuating device of a four-cycle internal combustion engine, comprising a valve actuating cam shaft having a valve actuating cam thereon and a rocker arm, wherein a cam holder block for carrying said cam shaft is fixed to a body of the engine and an adjusting bolt is held on the cam holder block in a manner that said bolt is adjustable relative to its position to the cam holder block, said adjusting bolt being integrally formed at one end thereof with a pivot portion, said rocker arm being rockably carried on said pivot portion and being operatively connected with said valve actuating cam on the valve actuating cam shaft, said rocker arm having a free end which is in direct operative connection with an opening and closing valve.

2. The device according to claim 1, wherein said rocker arm is associated, at two portions spaced in a longitudinal direction thereof, with said valve actuating cam shaft and said opening and closing valve, and said rocker arm engages said pivot portion at a portion of the arm spaced longitudinally from said two portions.

3. The device according to claim 2, wherein said portion of the rocker arm engaging the pivot portion comprises a hole to receive said pivot portion.

4. The device according to claim 3, wherein said pivot portion includes a spherical part and said hole includes a spherical recessed part placed in slide contact with said spherical part.

5. The device according to claim 3, wherein said pivot portion is formed into a columnar shape having flat side faces on opposite ends and having an axis located perpendicular to a direction of rocking motion of said rocker arm and wherein said hole comprises a recessed part of a circular arc slided with an outer peripheral surface of the pivot portion and flat side walls opposed to said flat side faces of the pivot portion.

6. The device according to claim 1, wherein said adjusting bolt is screwed to a female screw hole bored in the cam holder block.

7. The device according to claim 1, wherein said adjusting bolt is fitted into a fixing hole bored in the cam holder block and a pair of nuts are tightened to opposite ends of the adjusting bolt projecting out from the cam holder block.

8. The device according to claim 7, wherein means is provided to prevent rotation of the adjusting bolt within said fixing hole.

9. The device according to claim 3, 4 or 5, wherein means is provided to prevent dropping of said pivot portion out of said hole of the engaging portion of the rocker arm.

10. The device according to claim 1, wherein said valve actuating device is of an OHC type.

11. The device according to claim 1, wherein said opening and closing valve is either one of an intake valve and an exhaust valve.

12. The device according to claim 1, wherein said opening and closing valve is at least one of an intake valve and an exhaust valve.

13. The device according to claim 1, wherein said engine is of a four-valve type.

14. The device according to claim 1, wherein said engine is of a multi-cylinder type.

* * * * *